US009662525B2

(12) United States Patent
Lee et al.

(10) Patent No.: US 9,662,525 B2
(45) Date of Patent: May 30, 2017

(54) UPPER LIMB REHABILITATION ROBOT FOR MEAL ASSISTANCE OR MEAL REHABILITATION TRAINING AND METHOD THEREOF

(71) Applicant: Daegu Gyeongbuk Institute of Science and Technology, Daegu (KR)

(72) Inventors: Seung Yeol Lee, Daegu (KR); Tae Hun Kang, Daegu (KR); Dong Bin Shin, Gyeongsangnam-do (KR); Dae Jin Kim, Daegu (KR); Sung Hoon Eom, Daegu (KR); Jeon Il Moon, Daegu (KR)

(73) Assignee: Daegu Gyeongbuk Institute of Science and Technology, Daegu (KR)

( * ) Notice: Subject to any disclaimer, the term of this patent is extended or adjusted under 35 U.S.C. 154(b) by 701 days.

(21) Appl. No.: 14/050,384

(22) Filed: Oct. 10, 2013

(65) Prior Publication Data

US 2014/0316308 A1 Oct. 23, 2014

(30) Foreign Application Priority Data

Apr. 18, 2013 (KR) ..... 10-2013-0043216

(51) Int. Cl.
*A61H 1/00* (2006.01)
*A63B 21/00* (2006.01)
(Continued)

(52) U.S. Cl.
CPC ..... *A63B 21/00181* (2013.01); *A61H 1/0274* (2013.01); *A63B 21/0058* (2013.01);
(Continued)

(58) Field of Classification Search
CPC ..... A63B 21/00181; A63B 21/4043; A63B 21/4021; A63B 21/00178;
(Continued)

(56) References Cited

U.S. PATENT DOCUMENTS

2010/0160986 A1* 6/2010 Simmons ..... A61H 1/0237 607/3
2011/0251533 A1* 10/2011 Han ..... A61H 1/0274 601/33
(Continued)

FOREIGN PATENT DOCUMENTS

KR 10-1237245 B1 3/2013

*Primary Examiner* — Quang D Thanh
(74) *Attorney, Agent, or Firm* — Revolution IP, PLLC

(57) ABSTRACT

Provided are an upper limb rehabilitation robot including: a sensing member that is mounted and fixed to an upper limb of a user and captures motion of the upper limb according to a movement intention of the user; a motion control unit that is electrically connected to the sensing member, calculates a movement direction, a distance or angle, a speed, and an auxiliary force (target value) needed for the upper limb to move, intended by the upper limb, based on the motion captured by using the sensing member, and generates and outputs a control signal according to the calculated movement direction, distance or angle, speed, and auxiliary force (target value); and a multi-joint robot, to an end of an arm of which the sensing member is coupled, wherein the multi-joint robot guides movement of the upper limb fixed to the sensing member to selectively move or rotate toward a food tray placed at a designated position of a table along an X-axis, a Y-axis, or a Z-axis and provides an assistance force to the upper limb.

7 Claims, 9 Drawing Sheets

(51) Int. Cl.

| | |
|---|---|
| ***A61H 1/02*** | (2006.01) |
| ***A63B 21/005*** | (2006.01) |
| ***A63B 23/035*** | (2006.01) |
| ***A63B 23/12*** | (2006.01) |
| *A63B 22/00* | (2006.01) |

(52) U.S. Cl.
CPC .... *A63B 21/00178* (2013.01); *A63B 21/4021* (2015.10); *A63B 21/4043* (2015.10); *A63B 23/03508* (2013.01); *A63B 23/1209* (2013.01); *A61H 2201/1215* (2013.01); *A61H 2201/1638* (2013.01); *A61H 2201/1659* (2013.01); *A63B 2022/0094* (2013.01); *Y10S 901/09* (2013.01)

(58) Field of Classification Search
CPC ..... A63B 23/03508; A63B 23/1209; A63B 21/0058; A63B 2022/0094; A61H 1/0274; A61H 2201/1659; A61H 2201/1638; A61H 2201/1215; Y10S 901/09
See application file for complete search history.

(56) References Cited

U.S. PATENT DOCUMENTS

| | | | | |
|---|---|---|---|---|
| 2013/0041506 | A1 | 2/2013 | Song et al. | |
| 2013/0060171 | A1* | 3/2013 | Fu ..... | A61H 1/0274 601/5 |

* cited by examiner

UPPER LIMB REHABILITATION ROBOT FOR MEAL ASSISTANCE OR MEAL REHABILITATION TRAINING AND METHOD THEREOF

RELATED APPLICATIONS

This application claims the benefit of Korean Patent Application No. 10-2013-0043216, filed on Apr. 18, 2013, and No. 10-2013-0043217, filed on Apr. 18, 2013 in the Korean Intellectual Property Office, the disclosures of which are incorporated herein in their entirety by reference.

BACKGROUND

1. Field

One or more embodiments of the present invention relate to an upper limb rehabilitation robot for meal assistance of the elderly and the weak or rehabilitation patients who have relatively weak muscular strength or for active meal rehabilitation training during which a movement intention of a person is reflected, and a method of controlling the rehabilitation robot.

In detail, a sensing member, to which the upper limbs of a user are fixed, is mounted on a multi-joint robot, and motion of the upper limbs is sensed by using the sensing member to generate a control signal by using a motion control unit based on the sensed motion.

The present invention relates to an upper limb rehabilitation robot for meal assistance or meal rehabilitation training, wherein the upper limb is driven by using the multi-joint robot according to the generated control signal, and the multi-joint robot guides movement of the upper limbs and provides assistance force to the upper limbs so that the user may have meal properly.

2. Description of the Related Art

The life expectancy of humans is increasing each year, and countries in the world including Korea are rapidly becoming aging societies.

As the aging is processing worldwide, the silver industries are actively developed in the fields of supporting life, living, living activity, etc. and techniques needed therefore such as techniques for supporting replacing of a vital function, cure, self-support, and robot techniques for supporting daily life are also vigorously researched.

In particular, the elderly people have weakened muscle strength and are thus often not able to move by themselves and have restrictions in movement.

For the elderly people, particularly, due to the lacking muscle strength or a reduction in the muscle strength, they are restricted in many ways in terms of upper limb movement compared to normal people.

Thus, as a field in the silver industries, the need for a strength-supporting instrument to supplement and assist the muscle strength of the elderly and the weak has arisen.

However, the need for such a strength-supporting instrument is not only limited to the elderly and the weak.

A patient who has weak muscle strength due to various diseases, accident or other reasons would also need such a strength-supporting instrument. Also, rehabilitation patients who have difficulty in moving freely by one's own strength may also need the strength-supporting instrument for strength supplement or strength training.

Against this backdrop, various solutions have been suggested; for example, KR 10-1237245 (published on 18 Feb. 2013) discloses a meal assistance robot comprising a picking arm including a gripper that picks up food placed on a food tray; a feeding arm including a spoon on which the food picked up by the picking arm is placed and taking the spoon to the mouth of a user; a manipulation unit via which the user directs motion of the picking arm and the feeding arm; a control unit that is electrically connected to the picking arm, the feeding arm, and the manipulation unit to adjust motion of the picking arm and the feeding arm according to a command of the manipulation unit, wherein the manipulation unit is formed of a touch pad type liquid crystal display to display the shape of the food tray so that the picking arm and the feeding arm may be automatically manipulated to put food into the mouth of the user just by touching a position of the food tray on which the food the user wishes to eat is included.

However, according to the conventional art described above, simple and repetitive meal assistance or meal rehabilitation training is conducted passively by an operation program input by a robot programmer. Thus, no other task than having meal may be performed, and moreover, as physical characteristics of a user (e.g., a physique, a position of the mouth, or a degree of paralysis) are not considered, a considerable amount of inconvenience is caused to the user.

In addition, it is impossible to conduct the most appropriate rehabilitation motion program for the current physical state of individual patients.

Also, there is no measure against a malfunction of the robot, and thus a danger of safety accidents exists.

SUMMARY

One or more embodiments of the present include an Upper limb rehabilitation robot and its control method to control a robot rehabilitation, in which an movement intention of upper limbs of a user who has weaker upper limb strength than that of a normal person is detected so that a multi-joint robot may supplement the weak upper limb strength of the user or conduct active upper limb rehabilitation training. Accordingly, a user such as the elderly and the weak or a rehabilitation patient may not only have meal in a stable manner, but may also do any task to be done by upper limbs at a designated table, thereby increasing living convenience and being helpful in strength rehabilitation training.

In addition, as a sensing member, which is worn only on a portion of the upper limbs, is coupled to an end of the multi-joint robot by a magnetic force, the sensing member is supported by the multi-joint robot and the user may not sense the weight of the sensing member relatively, thereby improving wearing sensation compared to the conventional art.

Moreover, the user may make more various movements and move more freely by reflecting one's movement intention (e.g., a direction, a distance or angle, a speed to move), and also, during rehabilitation training, various movements may be made according to the intention of the user.

Furthermore, if the sensing member senses a force equal to or greater than a designated force, the sensing member is automatically separated from the multi-joint robot so as to protect the user from an accident due to a malfunction of the multi-joint robot.

According to one or more embodiments of the present invention, an upper limb rehabilitation robot for meal assistance, includes: a sensing member that is mounted and fixed to an upper limb of a user and captures motion of the upper limb according to a movement intention of the user; a motion control unit that is electrically connected to the sensing member, calculates a movement direction, a distance or angle, a speed, and an auxiliary force (target value) needed for the upper limb to move, intended by the upper limb, based on the motion captured by using the sensing member, and generates and outputs a control signal according to the calculated movement direction, distance or angle, speed, and auxiliary force (target value); and a multi-joint robot, to an end of an arm of which the sensing member is coupled, wherein the multi-joint robot guides movement of the upper limb fixed to the sensing member to selectively move or rotate toward a food tray placed at a designated position of a table along an X-axis, a Y-axis, or a Z-axis and provides an assistance force to the upper limb.

The sensing member may include: a cuff that includes an accommodation groove in which the upper limb of the user is accommodated and a plurality of coupling bands that fix the upper limb accommodated in the accommodation groove; a motion sensor that is included at the other side of the cuff and captures motion of the cuff to which the upper limb is fixed; and a first coupling member that is included on the other side surface of the motion sensor and is coupled to a second coupling member that is included at an end of the multi-joint robot, by a magnetic force, wherein the first coupling member fixes the cuff to the end of the multi-joint robot.

The first coupling member and the second coupling member may be coupled to each other by a magnetic force and configured such that a magnetic polarity of one of the first coupling member and the second coupling member is changed if the motion sensor senses a sensor signal of a range equal to or greater than a designated range or a motion speed of the multi-joint robot that is equal to or higher than a designated speed is observed in the motion control unit, so that the first coupling member and the second coupling member are separated from each other in an instant to release the coupling.

The upper limb rehabilitation robot for meal assistance may further include a wiper that is supported by a support coupled to the other side of the cuff to be disposed under the cuff and to clean up the upper surface of the table.

The motion sensor may include: a first sensor for sensing motion of the back of the hand in the fingers of the upper limb of the user; a second sensor for sensing motion of a wrist on the back of the hand of the upper limb of the user; and a third sensor for sensing motion from the wrist to the arm of the upper limb of the user.

The sensing member may further include a tableware sensor that senses a position of the tableware.

A tableware position sender may be attached on the plurality of pieces of tableware placed on the table so that the tableware sensor recognizes positions of the pieces of the tableware.

According to one or more embodiments of the present invention, a method of controlling an upper limb rehabilitation robot for meal assistance or meal rehabilitation training, the upper limb rehabilitation robot comprising a sensing member that captures motion of an upper limb of a user, a motion control unit that applies a control signal based on the motion captured by using the sensing member, and a multi-joint robot that moves the sensing member according to the control signal applied by using the motion control unit, includes: placing tableware on a preset designated position, mounting the sensing member, to which the upper limb of the user is fixed, to an end of an arm of the multi-joint robot by using a coupling member that is coupled by a magnetic force, and capturing motion of the upper limb of the user by using the sensing member; calculating a movement direction, a distance or angle, and a speed that the upper limb wishes and an auxiliary force (target value) needed for movement of the upper limb by using the motion control unit based on the motion captured by using the sensing member; generating and outputting a control signal along an X-axis, a Y-axis, or a Z-axis by using the motion control unit, which are to be output to the multi-joint robot in Cartesian coordinate system based on the calculated calculation values; and moving the upper limb by selectively driving the arm of the multi-joint robot along the X-axis, the Y-axis, or the Z-axis based on the respective control signals of the X-axis, the Y-axis, and the Z-axis that are output by the motion control unit by guiding a direction, a distance or angle, a speed and providing assistance force to the upper limb of the user according to a movement intention of the upper limb of the user.

The calculating of a movement direction, a distance or angle, and a speed that the upper limb wishes and an auxiliary force (target value) needed for movement of the upper limb may include: calculating a movement direction, a distance or angle, a speed, and an auxiliary force (target value) needed for the movement of the upper limb along the X-axis by using the motion control unit, by detecting motion of the upper limb to the left and the right or pitch by using the sensing member; calculating a movement direction, a distance or angle, a speed, and an auxiliary force (target value) needed for the movement of the upper limb along the Y-axis by using the motion control unit, by detecting forward and backward or roll motion of the upper limb by using the sensing member; and calculating a movement direction, a distance or angle, a speed, and an auxiliary force (target value) needed for the movement of the upper limb along the Z-axis by using the motion control unit, by detecting vertical or yaw motion of the upper limb by using the sensing member.

The calculating of a movement direction, a distance or angle, and a speed that the upper limb wishes, and an auxiliary force (target value) needed for the movement of the upper limb may include: comparing a calculation value with respect to a force and a reference value that is input in advance, by using the motion control unit; and if a measurement value of the motion control unit is equal to or greater than a reference value, or a movement speed of the multi-joint robot that is equal to or higher than a designated range is observed by the motion control unit, changing a magnetic polarity of one of the first coupling member and the second coupling member so as to output a control signal to separate the first and second coupling members from each other.

The method may further include: when the sensing member moves to the same, designated position, continuously and repeatedly, generating a Demo motion at the designated position at least once and storing and editing a movement track of the multi-joint robot in the motion control unit; and allowing the multi-joint robot to track the movement track continuously and repeatedly.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Hereinafter, preferred embodiments of the present invention will now be described with reference to the attached drawings. The meaning of the terms used in the present specification and claims of the present invention should not be limited to be of ordinary or literary meaning but construed as meanings and concepts not departing from the spirit and scope of the invention based on the principle that the inventor is capable of defining concepts of terms in order to describe his or her invention in the most appropriate way.

Accordingly, the features disclosed in the preferred embodiments and drawings of the present specification are examples of preferred embodiments of the present invention, and thus it should be understood that there are alternative equivalents or variation examples that can replace the preferred embodiments at the point of the filing of the present application.

Figure 1:
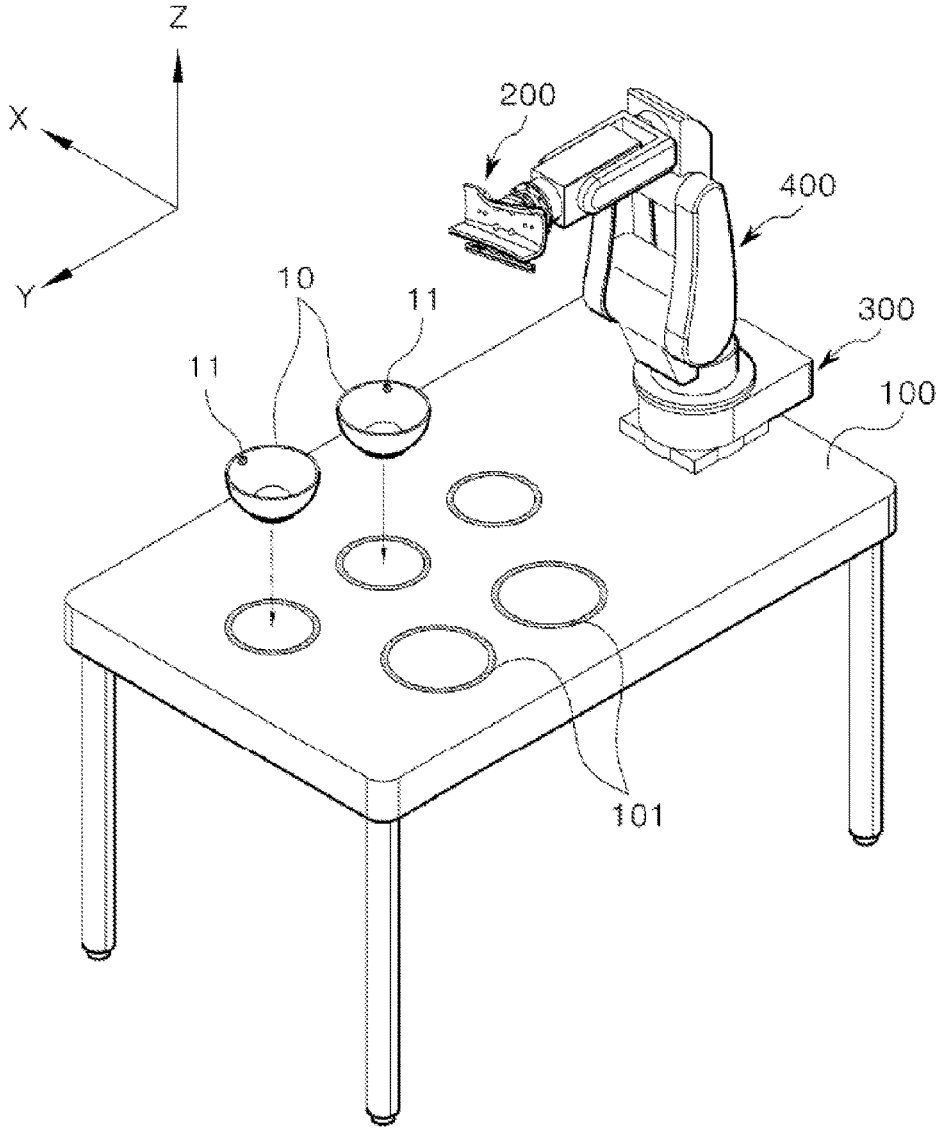
FIG. 1 is a schematic view of an upper limb rehabilitation robot for meal assistance or meal rehabilitation training, according to an embodiment of the present invention.
Figure 2:
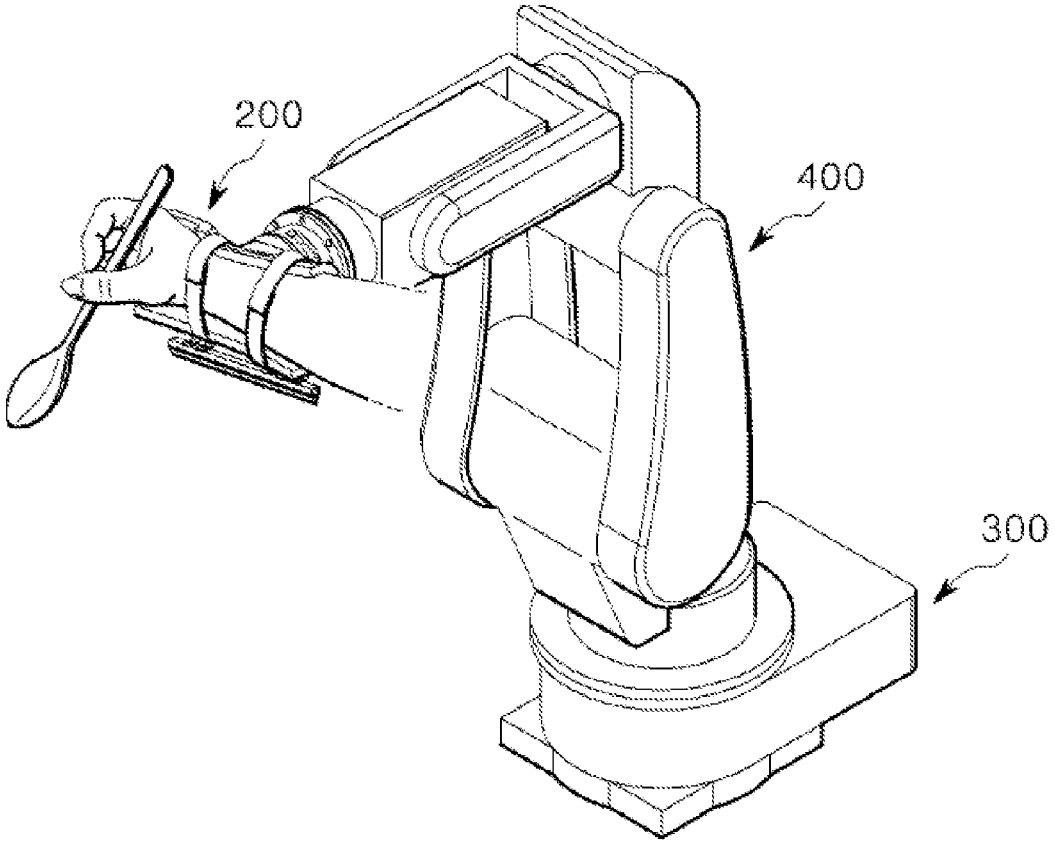
FIG. 2 is a schematic view illustrating an upper limb of a user fixed to the rehabilitation robot for meal assistance or meal rehabilitation training, according to an embodiment of the present invention.
Figure 3:
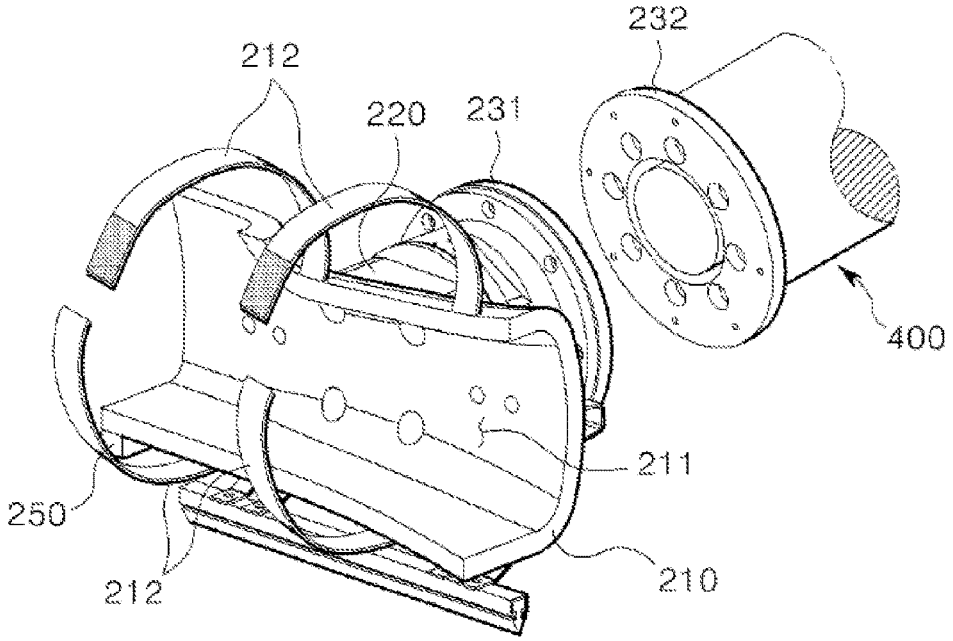
FIG. 3 is a schematic view illustrating a structure of a sensing member according to an embodiment of the present invention.
Figure 3:
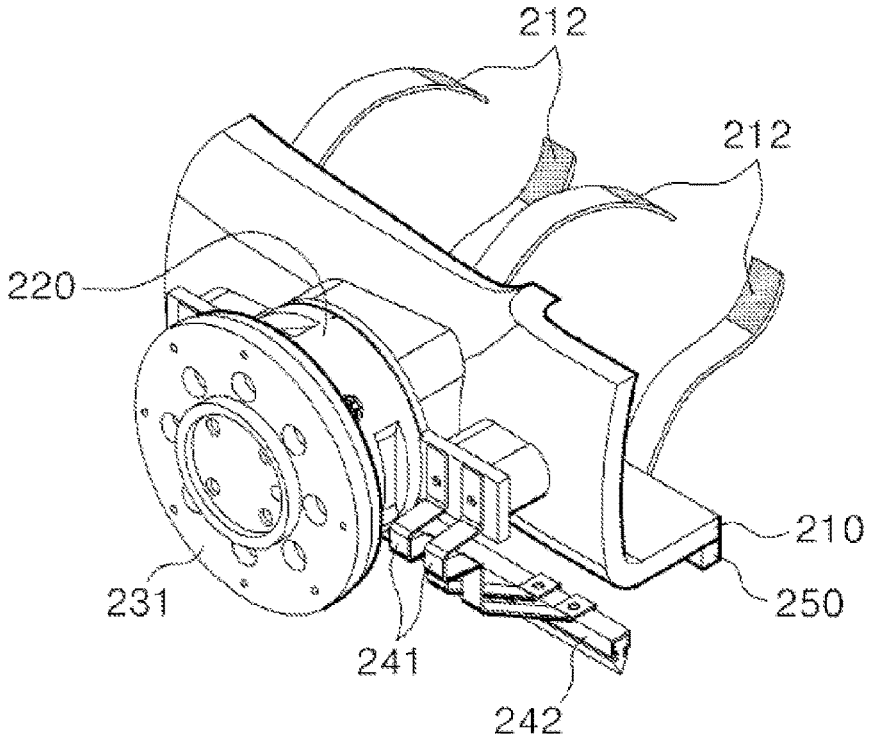
Figure 4:
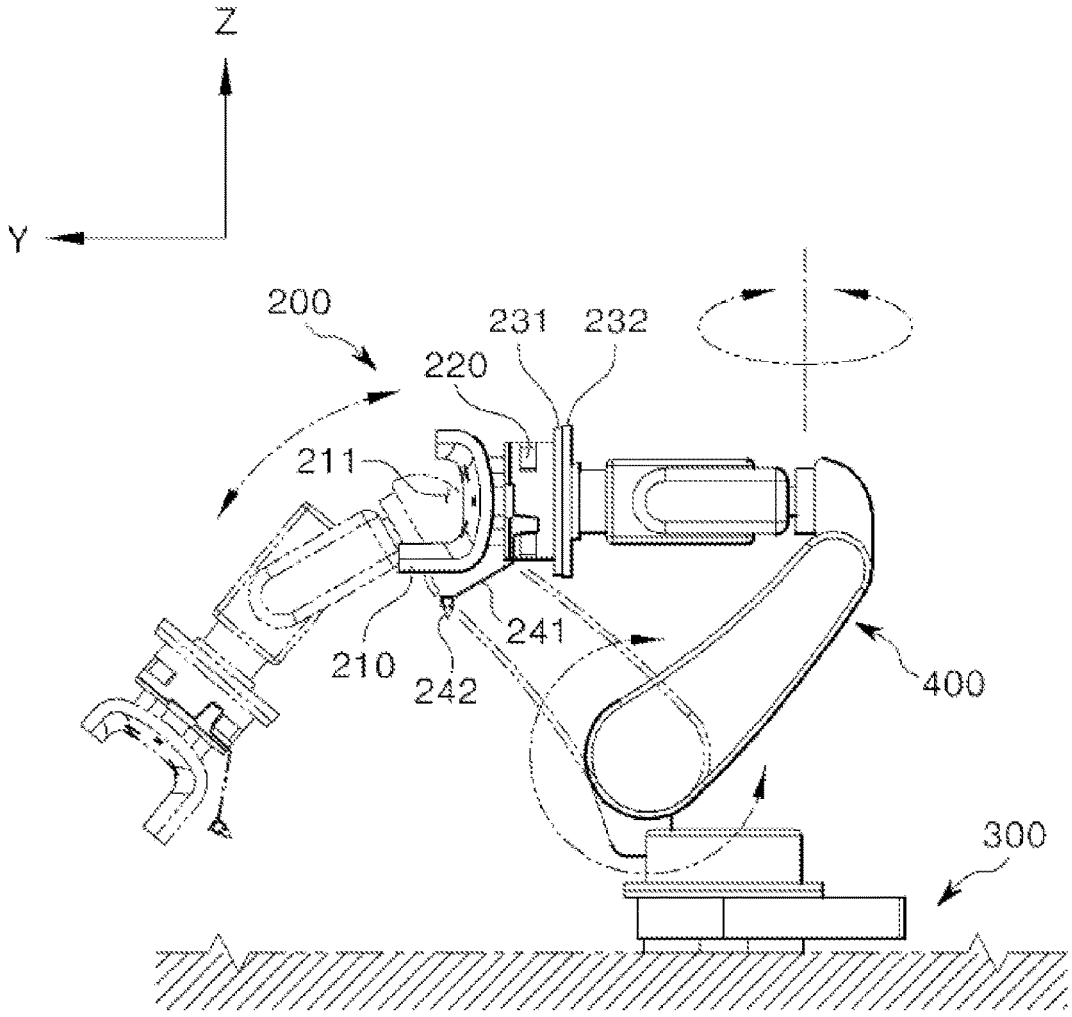
FIG. 4 is a schematic view illustrating an operating state of an upper limb rehabilitation robot for meal assistance or meal rehabilitation training, according to an embodiment of the present invention.
Figure 5:
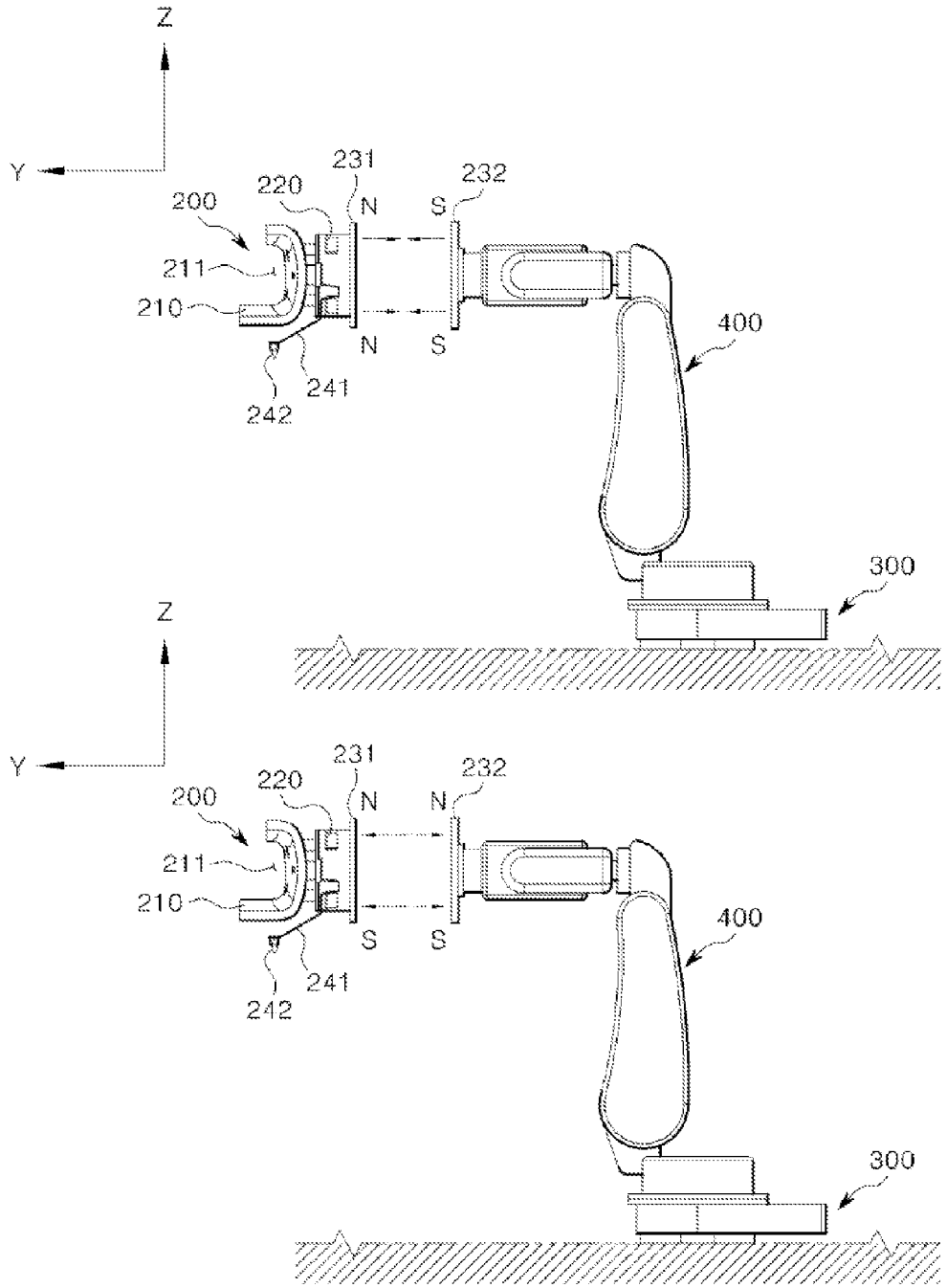
FIG. 5 is a schematic view illustrating a sensing member and a multi-joint robot that are coupled to each other via a first coupling member and a second coupling member, according to an embodiment of the present invention.
Figure 6:
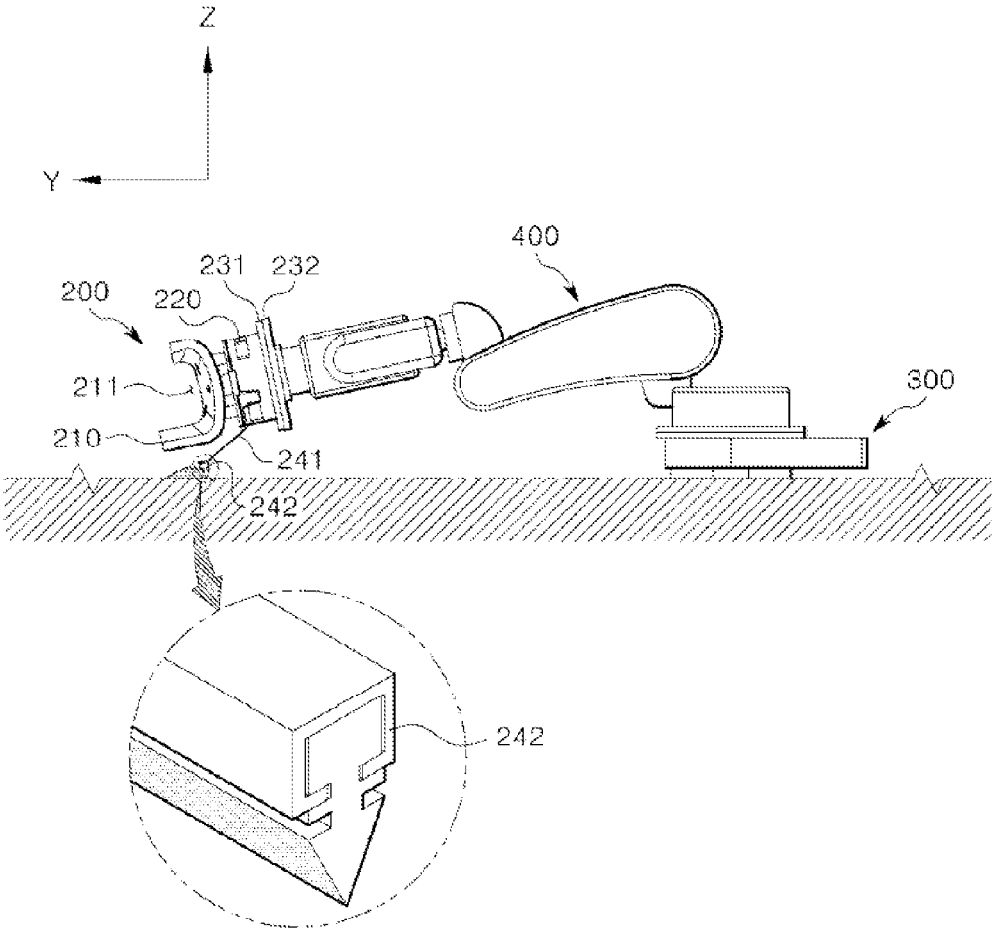
FIG. 6 is a schematic view illustrating a usage state of a wiper according to an embodiment of the present invention.

FIG. 1 is a schematic view of an upper limb rehabilitation robot for meal assistance or meal rehabilitation training, according to an embodiment of the present invention. FIG. 2 is a schematic view illustrating an upper limb of a user is fixed to the rehabilitation robot for meal assistance or meal rehabilitation training, according to an embodiment of the present invention. FIG. 3 is a schematic view illustrating a structure of a sensing member according to an embodiment of the present invention. FIG. 4 is a schematic view illustrating an operating state of an upper limb rehabilitation robot for meal assistance or meal rehabilitation training, according to an embodiment of the present invention. FIG. 5 is a schematic view illustrating a sensing member and a multi-joint robot that are coupled to each other via a first coupling member and a second coupling member, according to an embodiment of the present invention. FIG. 6 is a schematic view illustrating a usage state of a wiper according to an embodiment of the present invention.

The present invention relates to an upper limb rehabilitation robot for assisting meal of a rehabilitation patient who has relatively weak upper limb strength compared to a normal person and for active meal rehabilitation training during which a movement intention of the patient is reflected.

In detail, a table 100, on which tableware 10 is placed, a sensing member 200 that captures motion of an upper limb of a user, a motion control unit 300 that calculates the motion of the upper limb captured by using the sensing member 200 to output a control signal, and a multi-joint robot 400 that guides movement of the upper limb to the tableware 10 placed at a designated position on the table 100 and provides assistance force to the upper limb, based on the control signal output from the motion control unit 300, are included.

The table 100, the sensing member 200, the motion control unit 300, and the multi-joint robot 400 will be described in further detail with reference to the drawings below.

First, as illustrated in FIG. 1, the table 100 is where a plurality of pieces of the tableware 10 containing food are placed at designated positions and is in the form of a planar shape having a predetermined surface area.

A plurality of markings 101 are printed on an upper surface of the table 100 so that the designated positions of the tableware 10 placed on the table 100 may be recognizable.

Also, the upper surface of the table 100 may be partitioned into a plurality of sectors and the tableware 10 may be placed in each designated sector.

The sensing member 200 may be mounted and fixed to the upper limb of the user and capture motion of the upper limb according to a movement intention of the user.

The sensing member 200 will be further described in detail with reference to FIGS. 2 through 6. The sensing member 200 includes a cuff 210 to which the upper limb of the user is fixed and a motion sensor 220 that captures motion of the upper limb.

First, the cuff 210 includes an accommodation groove 211, in which the upper limb of the user is accommodated, at a side, and a plurality of coupling bands that fix the upper limb that is accommodated in the accommodation groove 211.

Accordingly, by accommodating the upper limb of the user in the accommodation groove 211 such that the back of the hand from among the upper limb is oriented inwardly, and then by tying and coupling the upper limb with the plurality of coupling bands 212, the upper limb of the user may be firmly fixed to the cuff 210.

Moreover, a support 241 is coupled to the cuff 210, and a wiper 242 that is horizontal to a ground surface is connectedly supported by the support 241 so that the wiper 242 may be disposed under the cuff 210.

The wiper 242 is included to remove food or foreign substances fallen on the upper surface of the table 100 and clean up the upper surface of the table 100.

The motion sensor 220 that captures motion of the cuff 210, to which the upper limb is fixed, is included at the other side of the cuff 210.

The motion sensor 220 may be formed of a single sensor or a plurality of sensors such as a gyro sensor, a tilt sensor, a piezoelectric sensor, or a torque sensor, which are capable of determining motion.

In addition, the motion sensor 220 may include three sensors so as to further capture motion precisely; for example, a first sensor (not shown) may sense motion of the back of the hand in the fingers of the upper limb of the user, a second sensor (not shown) may sense motion of the wrist on the back of the hand of the upper limb of the user, and a third sensor (not shown) may sense motion from the wrist to the arm of the upper limb of the user.

Also, a first coupling member 231 is included on the other side surface of the motion sensor 220; the first coupling member 231 is coupled to a second coupling member 232 that is included at an end of the multi-joint robot 400, by a magnetic force, thereby fixing the cuff 210 to the end of the multi-joint robot 400.

Accordingly, in order that the first coupling member 231 and the second coupling member 232 contact each other by a magnetic force so as to be coupled to each other, a plurality of magnetic substances (not shown) may be preferably included in the first coupling member 231, and also, a plurality of magnetic substances (not shown) corresponding to the magnetic substances (not shown) of the first coupling member 231 may be included in the second coupling member 232.

Here, the magnetic substances (not shown) of the first coupling member 231 and the magnetic substances (not shown) of the second coupling member 232 may have different polarities on contacting surfaces thereof so that the first and second coupling members 231 and 232 are coupled by an attractive force between the magnetic substances of difference polarities.

In addition, the first coupling member 231 and the second coupling member 232 may be configured such that a magnetic polarity of one of the first coupling member 231 and the second coupling member 232 is changed if the motion sensor 220 senses a sensor signal of a range equal to or greater than a designated range or a motion speed of the multi-joint robot 400 equal to or higher than a designated speed is observed in the motion control unit 300, so that the first coupling member 231 and the second coupling member 232 are separated from each other in an instant to release the coupling.

Accordingly, the magnetic substances (not shown) included in the second coupling member 232 may be formed of an electromagnet, and if the motion sensor 220 senses a sensor signal of a range equal to or greater than a designated range or a motion speed of the multi-joint robot 400 that is equal to or higher than a designated speed is observed in the motion control unit 300, a magnetic polarity of the electromagnet included in the second coupling member 232 may be converted to the same magnetic polarity as that of the magnetic substances (not shown) of the first coupling member 231 to thereby release the coupling by a repulsive force applied between the magnetic substances of the same magnetic polarity.

The motion control unit 300 may be electrically connected to the sensing member 200 and calculate a movement direction, a distance or angle, and a speed that the upper limb wishes, and an amount of a force needed for movement of the upper limb A, based on motion captured by using the sensing member 200, and generate a control signal to be applied to the multi-joint robot 400 according to calculated various information and output the control signal.

The motion control unit 300 may be connected to the sensing member 200 via a cable or a wireless communication unit so that data may be input or output.

The sensing member 200 may be coupled to an end of an arm of the multi-joint robot 400, and the multi-joint robot 400 guides the upper limb of the user fixed to the sensing member 200 to selectively move or rotate the upper limb toward the tableware 10 placed on a designated position of the table 100 with respect to an X-axis, a Y-axis, or a Z-axis in the Cartesian coordinate system, based on calculation values output by the motion control unit 300.

According to another embodiment of the present invention, a tableware sensor 250 that senses a position of the tableware 10 may be further included in the sensing member 200.

A tableware position sender 11 may be further included in the plurality of pieces of tableware 10 placed on the table 100 so that the tableware sensor 250 may recognize positions of the tableware 10.

According to the upper limb rehabilitation robot for meal assistance or meal rehabilitation training of the current embodiment of the present invention, the food tray 10 containing food is placed on the marking 101 printed at a designated position on the upper surface of the table 100, and the sensing member 200 which is fixed to the upper limb of the user is coupled and mounted to an end of the arm of the multi-joint robot 400.

As the user starts having meal by taking the spoon and chopsticks, the sensing member 200 captures motion of the upper limb that intends to move according to the movement intention of the user.

To calculate a movement direction, a distance or angle, or a speed that the upper limb wishes, and an auxiliary force (target value) needed for movement of the upper limb A, the sensing member 200 measures an amount and a direction of a force (or torque) provided by the upper limb with respect to the X axis, the Y axis, or the Z axis in the Cartesian coordinate system.

Then, the motion control unit 300 calculates the movement direction, the distance or angle, and the speed to be reached by the multi-joint robot 400 and the auxiliary force (target value) to be generated, along the X-axis, the Y-axis, or the Z-axis in the Cartesian coordinate system.

In addition, the motion control unit 300 measures a speed of the multi-joint robot 400 and calculates energy provided by the upper limb to the sensing member 200 according to the movement intention of the user, and the motion control unit 300 adjusts the movement direction, the distance or angle, and the speed to be reached by the multi-joint robot 400 along the X-axis, the Y-axis, or the Z-axis in the Cartesian coordinate system.

The calculated auxiliary force (target value) to be reached by the multi-joint robot 400 is used to generate a control signal of each of the X-axis, the Y-axis, and the Z-axis to be output to the multi-joint robot 400, and the control signal is output to each servo driver of the multi-joint robot 400.

The arm of the multi-joint robot 400 is selectively driven based on the output control signal of each of the X-axis, the Y-axis, and the Z-axis so that the multi-joint robot 400 provides an assistance force so as to move the upper limb as wished by the user.

When the upper limb moves to the same, designated position, continuously and repeatedly, a Demo motion may be generated at the designated position at least once and then a movement track thereof may be stored and edited in the motion control unit 300 so that the multi-joint robot 400 tracks the movement track continuously and repeatedly if the continuous and repetitive movement is necessary.

Hereinafter, a method of controlling the upper limb rehabilitation robot for meal assistance as illustrated in FIGS. 1 through 6 will be described with reference to FIGS. 7 through 9.

Figure 7:
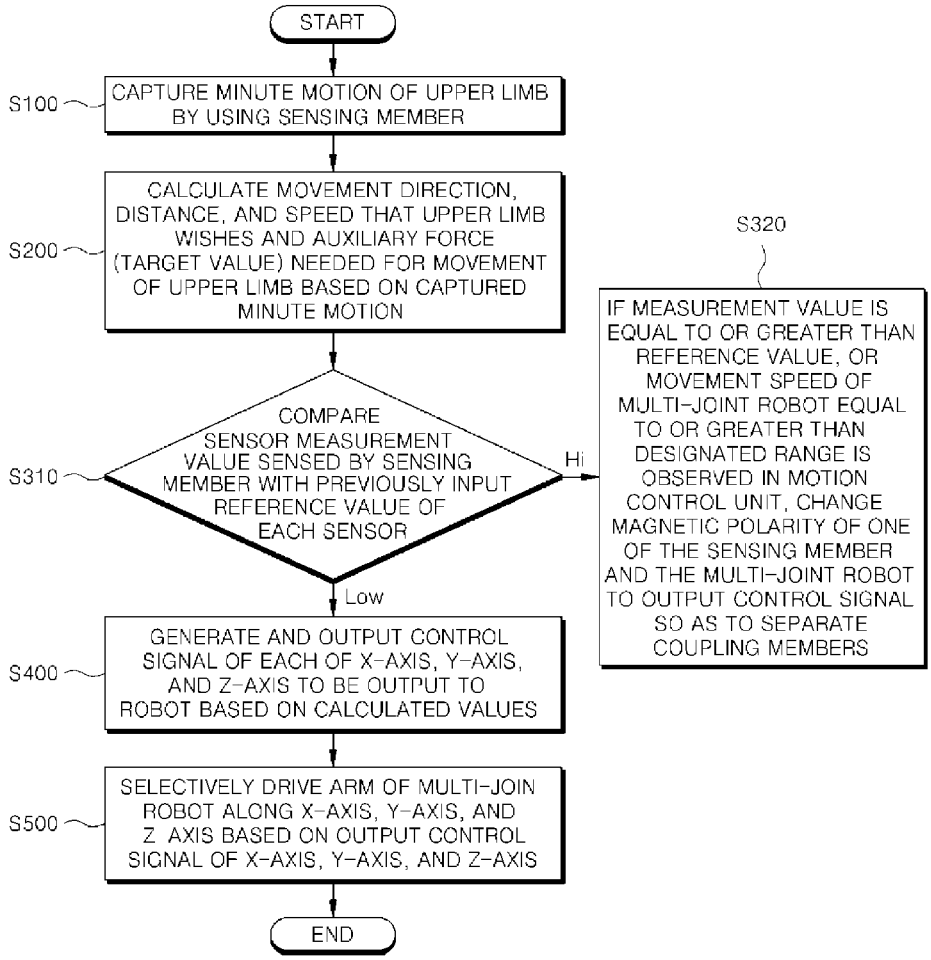
FIG. 7 is a flowchart illustrating a method of controlling an upper limb rehabilitation robot for meal assistance or meal rehabilitation training, according to an embodiment of the present invention.
Figure 8:
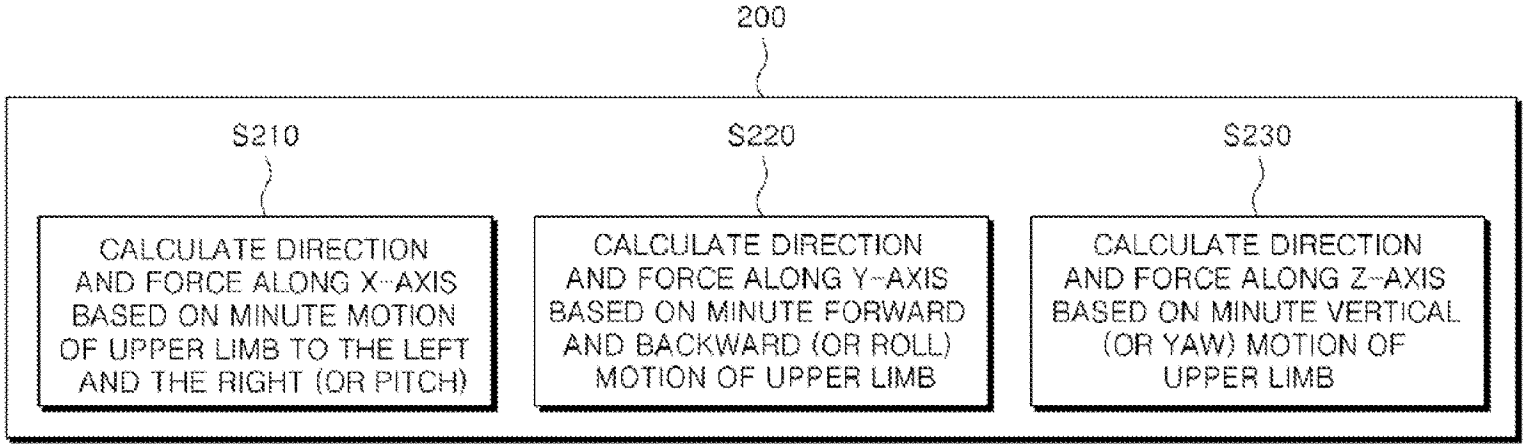
FIG. 8 is a detailed block diagram illustrating operation S200 of FIG. 7.

FIG. 7 is a flowchart illustrating a method of controlling the upper limb rehabilitation robot for meal assistance or meal rehabilitation training, according to an embodiment of the present invention. FIG. 8 is a detailed block diagram illustrating operation S200 of FIG. 7. FIG. 9 is a flowchart illustrating a method of controlling the upper limb rehabilitation robot for meal assistance or meal rehabilitation training, according to an embodiment of the present invention.

As illustrated in FIG. 7, according to the current embodiment of the present invention, first, the sensing member 200 captures a movement intention of a user by detecting motion of the upper limb of the user in operation S100.

The sensing member 200 captures motion of the upper limb along an X-axis, a Y-axis, or a Z-axis in Cartesian coordinate system by using various sensors.

Next, in operation S200, the motion control unit 300 detects a movement intention of the user according to the motion captured in operation S100 to calculate a movement direction, a distance or angle, and a speed that the upper limb wishes, and an auxiliary force (target value) needed for movement of the upper limb A.

Operation S200 will be further described in detail with reference to FIG. 8. The motion control unit 300 calculates a direction and a force of the upper limb along the X-axis, the Y-axis, or the Z-axis based on the motion captured by using the sensing member 200.

In other words, in operation S210, the motion control unit 300 calculates a direction, a distance (or angle), a speed, and a force along the X-axis based on left and right or pitch motion detection values captured by using the sensing member 200 according to movement of the upper limb to the left or to the right or pitch according to the intention of the user.

In operation S220, the motion control unit 300 calculates a direction, a distance or angle, a speed, and a force along the Y-axis based on forward and backward or roll motion detection values detected by using the sensing member 200 according to forward or backward or roll motion of the upper limb according to the intention of the user.

In operation S230, the motion control unit 300 calculates a direction, a distance or angle, a speed, and a force along the Z-axis based on vertical or yaw motion detection values detected by using the sensing member 200 according to vertical or yaw motion of the upper limb according to the intention of the user.

The motion control unit 300 compares sensor signal measurement values regarding motion of the upper limb captured by using the sensing member 200 in operation S100 and previously input reference values of the respective sensors in operation S310.

In operation S310, if a measurement value is equal to or greater than a reference value, or a movement speed of the multi-joint robot 400 that is equal to or higher than a designated range is observed by the motion control unit 300, a magnetic polarity of one of the first coupling member 231 and the second coupling member 232, which allow the sensing member 200 to be mounted on the multi-joint robot 400, is changed so as to output a control signal to separate the first and second coupling members 231 and 232 from each other in operation S320.

Accordingly, a polarity of an electromagnet included in the second coupling member 232 described with reference to the structure of the upper limb rehabilitation robot for meal assistance is changed to be the same as that of the magnetic substances (not shown) of the first coupling member 231 so that the coupling is released by a repulsive force applied between the magnetic substances of the same polarity.

In addition, in operation S400, the motion control unit 300 generates control signals of the X-axis, the Y-axis, or the Z-axis to be output to the multi-joint robot 400 based on the calculation values calculated in operation S200 and output the control signals.

The control signals are output to each servo driver of the X-axis, the Y-axis, and the Z-axis included in the multi-joint robot 400.

In operation S500, the multi-joint robot 400 drives the arm of the multi-joint robot 400 selectively along the X-axis, the Y-axis, or the Z-axis based on the respective control signals of the X-axis, the Y-axis, and the Z-axis that are output by the motion control unit 300 in operation S400, thereby moving the upper limb of the user in a movement direction, by a distance or angle, and at a speed as wished initially.

Figure 9:
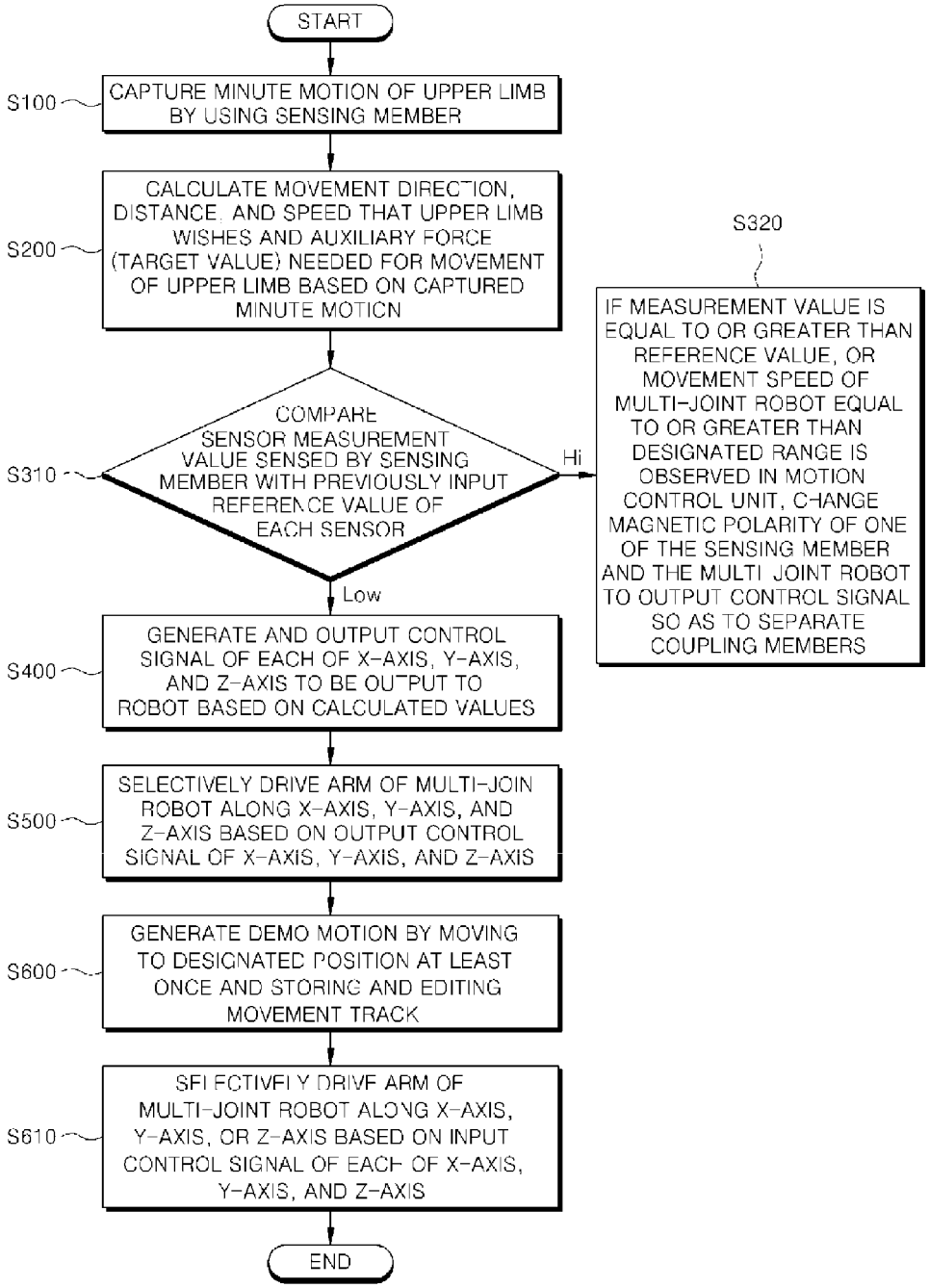
FIG. 9 is a flowchart illustrating a method of controlling an upper limb rehabilitation robot for meal assistance or meal rehabilitation training, according to an embodiment of the present invention.

According to another embodiment of the present invention, if the upper limb moves to the same, designated position, continuously and repeatedly, as illustrated in FIG. 9, the method may further include operation S600 of moving the upper limb to the designated position at least once and generating a Demo motion by storing and editing a movement track by using the motion control unit 300.

When the Demo motion is generated, the user does not have to continuously move the upper limb until a target point is reached in order to move the upper limb to the target point; instead, the Demo motion is executed, and the upper limb is moved just according to initial motion along the movement track that is learned and stored in the motion control unit 300.

In operation S610, when the Demo motion is executed, the multi-joint robot 400 selectively drives the arm of the multi-joint robot 400 along the X-axis, the Y-axis, or the Z-axis based on each control signal along the X-axis, the Y-axis, or the Z-axis stored while generating the Demo motion by using the motion control unit 300, thereby moving the upper limb of the user in a movement direction, by a distance or angle, and at a speed as wished initially.

As described above, according to the one or more of the above embodiments of the present invention, an movement intention of upper limbs of a user who has relatively weak upper limb strength compared to that of a normal person is detected so that a multi-joint robot may supplement the weak upper limb strength of the user or conduct active upper limb rehabilitation training. Accordingly, a user such as the elderly or a rehabilitation patient may not only have meal in a stable manner, but may also do any task to be done by upper limbs at a designated table, thereby increasing living convenience and being helpful in strength rehabilitation training.

In addition, as a sensing member which is worn only on a portion of the upper limbs is coupled to an end of the multi-joint robot by a magnetic force, the sensing member is supported by the multi-joint robot and the user may not sense the weight of the sensing member relatively, thereby improving wearing sensation compared to the conventional art.

Moreover, the user may make more various movements and move more freely by reflecting one's movement intention (e.g., a direction, a distance or angle, a speed to move), and also, during rehabilitation training, various movements may be made according to the intention of the user.

Furthermore, if the sensing member senses a force equal to or greater than a designated force, the sensing member is automatically separated from the multi-joint robot so as to protect the user from an accident due to a malfunction of the multi-joint robot.

While one or more embodiments of the present invention have been described with reference to the figures, it will be understood by those of ordinary skill in the art that various changes in form and details may be made therein without departing from the spirit and scope of the present invention as defined by the following claims.

What is claimed is:

1. An upper limb rehabilitation robot for meal assistance, comprising:

a sensing member adapted to be mounted and fixed to an upper limb of a user, the sensing member configured to detect and to capture a motion of an upper limb of the user, the sensing member including a first coupling member;

a motion control unit electrically connected to the sensing member, the motion control unit configured to calculate a direction, a distance, an angle, a speed, and an auxiliary force associated with respective one of movements of the upper limb, calculation of the direction, distance, angle, speed, and auxiliary force being performed based on the motion detected and captured by the sensing member, the motion control unit further configured to generate and output a control signal according to the calculated direction, distance, angle, speed, and auxiliary force; and a multi joint robot including a second coupling member being coupled to an end of an arm, the first coupling member of the sensing member and the second coupling member being detachably coupled to each other using a magnetic force and a magnetic polarity of one of the first coupling member and the second coupling member is changed in response to detection of a value of sensor signal being equal to or greater than a threshold range value, wherein the multi-joint robot is configured to guide respective one of the movements of the upper limb to selectively move or rotate toward a food tray placed at a designated position of a table along an X-axis, a Y-axis, or a Z-axis by providing an assistance force to the upper limb.

2. The upper limb rehabilitation robot for meal assistance of claim 1, wherein the sensing member further comprises a tableware sensor that senses a position of the tableware.

3. The upper limb rehabilitation robot for meal assistance of claim 2, wherein a tableware position sender is attached on a plurality of pieces of tableware placed on the table so that the tableware sensor recognizes positions of the pieces of the tableware.

4. An upper limb rehabilitation robot, comprising:

a sensing member adapted to be mounted and fixed to an upper limb of a user, the sensing member configured to detect and to capture a motion of an upper limb of the user;

a motion control unit electrically connected to the sensing member, the motion control unit configured to calculate a direction, a distance, an angle, a speed, and an auxiliary force associated with respective one of movements of the upper limb, calculation of the direction, distance, angle, speed, and auxiliary force being performed based on the motion detected and captured by the sensing member, the motion control unit further configured to generate and output a control signal according to the calculated direction, distance, angle, speed, and auxiliary force; and a multi joint robot, to an end of an arm of which the sensing member is coupled, the multi joint robot configured to guide respective one of the movements of the upper limb to selectively move or rotate toward a food tray placed at a designated position of a table along an X-axis, a Y-axis, or a Z-axis by providing an assistance force to the upper limb, wherein the sensing member comprises:

a cuff that includes an accommodation groove in which the upper limb of the user is accommodated and a plurality of coupling bands are adapted to be fixed to the upper limb accommodated in the accommodation groove;

a motion sensor is configured at a portion of the cuff to capture motion of the cuff adapted to be fixed to the upper limb; and a first coupling member is configured on a portion of the motion sensor and is coupled to a second coupling member that is included at an end of the multi-joint robot, by a magnetic force, wherein the first coupling member is configured to fix the cuff to the end of the multi-joint robot.

5. The upper limb rehabilitation robot of claim 4, wherein the first coupling member and the second coupling member are coupled to each other by a magnetic force and configured such that a magnetic polarity of one of the first coupling member and the second coupling member is changed if the motion sensor senses a sensor signal of a range equal to or greater than a designated range or a motion speed of the multi joint robot that is equal to or higher than a designated speed is observed in the motion control unit, so that the first coupling member and the second coupling member are separated from each other in an instant to release the coupling.

6. The upper limb rehabilitation robot of claim 4, further comprising a wiper that is supported by a support coupled to a second side of the cuff to be disposed under the cuff and to clean up an upper surface of the table.

7. The upper limb rehabilitation robot of claim 4, wherein the motion sensor comprises:

a first sensor for sensing motion detected from a back of a hand to fingers of the upper limb of the user;

a second sensor for sensing motion detected from a wrist to a back of the hand of the upper limb of the user; and a third sensor for sensing motion detected from the wrist to an arm of the upper limb of the user.

* * * * *